US008590319B2

(12) United States Patent
Xu

(10) Patent No.: US 8,590,319 B2
(45) Date of Patent: Nov. 26, 2013

(54) PULSE TUBE REFRIGERATOR

(75) Inventor: Mingyao Xu, Saitama (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 384 days.

(21) Appl. No.: 12/659,719

(22) Filed: Mar. 18, 2010

(65) Prior Publication Data

US 2010/0257872 A1 Oct. 14, 2010

(30) Foreign Application Priority Data

Apr. 8, 2009 (JP) ..... 2009-094309

(51) Int. Cl.
*F25B 9/00* (2006.01)
*F25B 19/00* (2006.01)
*B01D 8/00* (2006.01)

(52) U.S. Cl.
USPC ..... 62/6; 62/55.5; 62/51.1

(58) Field of Classification Search
USPC ..... 62/6, 600, 55.5, 51.1
See application file for complete search history.

(56) References Cited

U.S. PATENT DOCUMENTS 5,107,683 A * 4/1992 Chan et al. ..... 62/6
5,423,952 A * 6/1995 Stout ..... 202/174
6,256,998 B1 * 7/2001 Gao ..... 62/6
6,343,475 B1 * 2/2002 Ishikawa ..... 62/6
6,389,819 B1 * 5/2002 Zhu et al. ..... 62/6
6,715,300 B2 * 4/2004 Longsworth ..... 62/6
7,600,385 B2 * 10/2009 Yan ..... 62/6
2003/0213251 A1 * 11/2003 Hofmann ..... 62/6
2006/0174635 A1 8/2006 Xu et al.
2008/0256958 A1 * 10/2008 Xu ..... 62/6

FOREIGN PATENT DOCUMENTS

JP 2000-074518 A 3/2000
JP 2001-165517 A 6/2001
JP 2006-214717 A 8/2006

OTHER PUBLICATIONS

JPO Office Action, App. No. 2009-094309, Transmission Date: Nov. 24, 2010 (2 pages).

* cited by examiner

*Primary Examiner* — Frantz Jules
*Assistant Examiner* — Keith Raymond

(57) ABSTRACT

A multi-stage pulse tube refrigerator includes a first stage regenerator tube including a heat exchanger; a second stage regenerator tube; a first stage pulse tube; a second stage pulse tube; a first cooling stage connected to the first stage regenerator tube and the first stage pulse tube; and a second cooling stage connected to the second stage regenerator tube and the second stage pulse tube. A cold end of the first stage regenerator tube is connected to the first stage pulse tube via a first flow path and connected to the second stage regenerator tube via a second flow path. The first flow path is configured such that a heat exchange occurs between the heat exchanger and a refrigerant gas flowing through the first flow path, and the second flow path is configured such that the refrigerant gas flowing through the second flow path bypasses the heat exchanger.

7 Claims, 3 Drawing Sheets

PULSE TUBE REFRIGERATOR

BACKGROUND OF THE INVENTION

1. Field of the Invention

A certain aspect of the present invention relates to a pulse tube refrigerator.

2. Description of the Related Art

Pulse tube refrigerators are widely used to cool apparatuses, such as a magnetic resonance imaging (MRI) apparatus, that require a cryogenic environment.

In a pulse tube refrigerator, a refrigerant gas (e.g., helium gas), i.e., a working fluid, compressed by a gas compressor is repeatedly caused to flow into regenerator tubes and pulse tubes and then to flow out of the regenerator tubes and the pulse tubes back into the gas compressor. As a result, "coldness" is generated at cold ends of the regenerator tubes and the pulse tubes. The cold ends are brought into thermal contact with an object to draw heat from the object.

Take, for example, a two-stage pulse tube refrigerator including a first stage regenerator tube, a second stage regenerator tube, a first stage pulse tube, and a second stage pulse tube.

Normally, the first and second stage regenerator tubes are implemented by cylinders containing a cold storage medium and the first and second stage pulse tubes are implemented by hollow cylinders. One end of each cylinder functions as a hot end and the other end of the cylinder functions as a cold end. A first cooling stage is provided at the cold ends of the first stage regenerator tube and the first stage pulse tube, and a second cooling stage is provided at the cold ends of the second stage regenerator tube and the second stage pulse tube. An object to be cooled is brought into contact with the cooling stages. The cold end of the first stage regenerator tube is connected and communicates with the hot end of the second stage regenerator tube.

Typically, heat exchangers are provided at the cold ends of the first and second stage pulse tubes to transfer the "coldness" from the refrigerant gas (i.e., to transfer heat from the heat exchanger to the refrigerant gas).

However, disposing the heat exchangers at the cold ends of the first and second stage pulse tubes increases the total lengths of the first and second stage pulse tubes and thereby increases the total size of the pulse tube refrigerator. For this reason, in some pulse tube refrigerators, a part or all of the heat exchangers are provided at the cold ends of the first and second stage regenerator tubes to reduce the sizes of the pulse tube refrigerators (see, for example, patent document 1).

Assuming that a heat exchanger is provided at the cold end of the first stage regenerator tube, the refrigerant gas flows into the heat exchanger from the first stage pulse tube and from the second stage pulse tube via the second stage regenerator tube, and heat exchange takes place between the heat exchanger and the refrigerant gas.

[Patent document 1] U.S. Pat. No. 6,715,300 B2

When the refrigerant gas is recovered by the gas compressor, the refrigerant gas flows into the first stage regenerator tube from the first stage pulse tube and from the second pulse tube via the second regenerator tube as described above. Here, the heat exchanger provided at the cold end of the first stage regenerator tube is used to transfer (or absorb) the coldness from the refrigerant gas flowing into the first stage regenerator tube.

However, it is expected that the amount of heat (or coldness) exchanged between the heat exchanger and the refrigerant gas flowing into the first stage regenerator tube from the second stage pulse tube via the second stage regenerator tube is very small. This is because a substantial amount of coldness is transferred from the refrigerant gas to the cold storage medium in the second stage regenerator tube before the refrigerant gas passes through the hot end of the second stage regenerator tube. In other words, the cooling capability of the refrigerant gas is reduced to a low level when it reaches the heat exchanger.

Meanwhile, regardless of whether heat exchange occurs between the heat exchanger and the refrigerant gas from the second stage regenerator tube, the pressure of the refrigerant gas drops as long as the refrigerant gas passes through the heat exchanger. In other words, although no substantial heat exchange occurs between the heat exchanger and the refrigerant gas flowing from the second stage regenerator tube into the first stage regenerator tube, the pressure of the refrigerant gas drops "unnecessarily".

Such pressure loss may decrease the total cooling capability of the pulse tube refrigerator and therefore has to be reduced.

SUMMARY OF THE INVENTION

An aspect of the present invention provides a multi-stage pulse tube refrigerator. The multi-stage pulse tube refrigerator includes a first stage regenerator tube including a heat exchanger; a second stage regenerator tube; a first stage pulse tube; a second stage pulse tube; a first cooling stage connected to a cold end of the first stage regenerator tube and a cold end of the first stage pulse tube; and a second cooling stage connected to a cold end of the second stage regenerator tube and a cold end of the second stage pulse tube. The cold end of the first stage regenerator tube is in communication with the first stage pulse tube via a first flow path and in communication with the second stage regenerator tube via a second flow path. The first flow path is configured such that a heat exchange occurs between the heat exchanger and a refrigerant gas flowing through the first flow path, and the second flow path is configured such that the refrigerant gas flowing through the second flow path bypasses the heat exchanger.

DESCRIPTION OF THE PREFERRED EMBODIMENTS

Preferred embodiments of the present invention are described below with reference to the accompanying drawings.

For a better understanding of the present invention, a configuration and operations of a related-art two-stage pulse tube refrigerator are described below with reference to FIG. 1.

Figure 1:
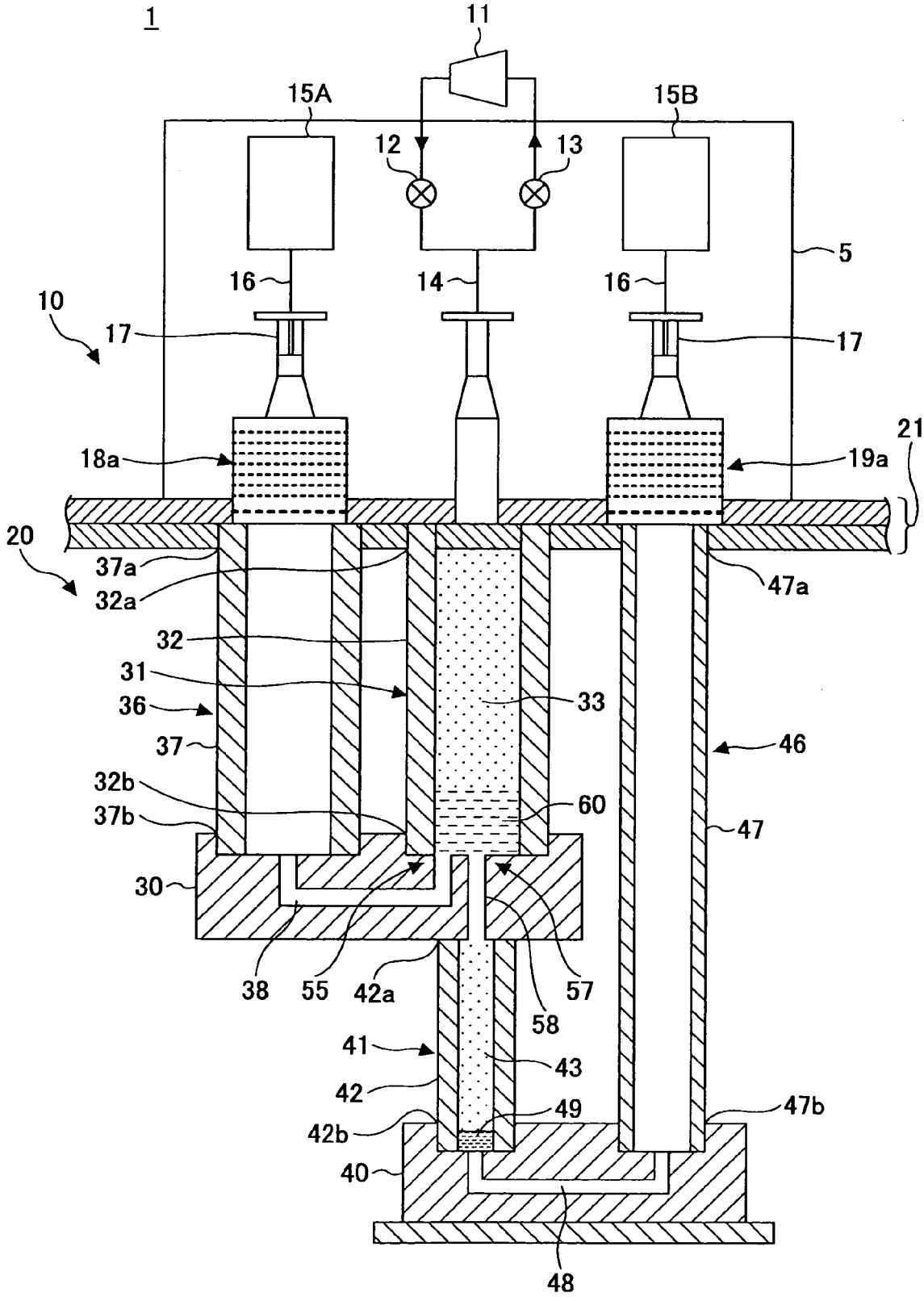
FIG. 1 is a schematic diagram of a related-art two-stage pulse tube refrigerator.

FIG. 1 is a schematic diagram of a related-art two-stage pulse tube refrigerator 1.

The two-stage pulse tube refrigerator 1 includes a gas compressor 11, a housing unit 10, a flange 21, and a cold head 20 connected via the flange 21 to the housing unit 10.

The gas compressor 11 forces a refrigerant gas such as helium gas to flow into the housing unit 10 and the cold head 20 at a high pressure and evacuates the refrigerant gas from the housing unit 10 and the cold head 20 at certain intervals.

The housing unit 10 includes a housing 5. The housing 5 houses a first stage reservoir 15A, a second stage reservoir 15B, upper heat exchangers 18*a* and 19*a*, an intake valve 12, an exhaust valve 13, and orifices 17. The intake valve 12 and the exhaust valve 13 are connected via gas piping 14 to the gas compressor 11. The housing 5 may be made of aluminum or an aluminum alloy.

The cold head 20 includes a first stage regenerator tube 31, a first stage pulse tube 36, a first cooling stage 30, a second stage regenerator tube 41, a second stage pulse tube 46, and a second cooling stage 40.

The first stage regenerator tube 31 includes a hollow cylinder 32 made of, for example, a stainless steel; a cold storage medium 33 filling the cylinder 32; and a heat exchanger 60. The cold storage medium 33 is implemented, for example, by a wire mesh made of copper or a stainless steel. The heat exchanger 60 is implemented, for example, by a perforated plate. A hot end 32*a* of the first stage regenerator tube 31 is in contact with and fixed to the flange 21, and a cold end 32*b* of the first stage regenerator tube 31 is in contact with and fixed to the first cooling stage 30. The cold end 32*b* has a first flow opening 55 and a second flow opening 57.

The first stage pulse tube 36 includes a hollow cylinder 37 made of, for example, a stainless steel. A hot end 37*a* of the first stage pulse tube 36 is in contact with and fixed to the flange 21 and a cold end 37*b* of the first stage pulse tube 36 is in contact with and fixed to the first cooling stage 30. The cold end 32*b* of the first stage regenerator tube 31 and the cold end 37*b* of the first stage pulse tube 36 are connected to each other via the first cooling stage 30.

A first flow path 38 formed in the first cooling stage 30 is connected to the first flow opening 55 of the cold end 32*b* of the first stage regenerator tube 31. The first cooling stage 30 is thermally and mechanically connected to an object (not shown) to be cooled so that the coldness is transferred from the first cooling stage 30 to the object.

The second stage regenerator tube 41 includes a hollow cylinder 42 made of, for example, a stainless steel; and a cold storage medium 43 filling the cylinder 42. The cold storage medium 43 is, for example, made of lead balls or a magnetic material. A hot end 42*a* of the second stage regenerator tube 41 is in contact with and fixed to the first cooling stage 30 and a cold end 42*b* of the second stage regenerator tube 41 is in contact with and fixed to the second cooling stage 40. A heat exchanger 49 implemented, for example, by a perforated plate is provided at the cold end 42*b* of the second stage regenerator tube 41. The second stage regenerator tube 41 is connected to the first stage regenerator tube 31 via a second flow path 58 connected to the second flow opening 57 of the cold end 32*b* of the first stage regenerator tube 31 such that the refrigerant gas can flow between the first stage regenerator tube 31 and the second stage regenerator tube 41.

The second stage pulse tube 46 includes a hollow cylinder 47 made of, for example, a stainless steel. A hot end 47*a* of the second stage pulse tube 46 is in contact with and fixed to the flange 21 and a cold end 47*b* of the second stage pulse tube 46 is in contact with and fixed to the second cooling stage 40.

A gas flow path 48 is formed in the second cooling stage 40 to connect the cold end 47*b* of the second stage pulse tube 46 and the cold end 42*b* of the second stage regenerator tube 41. The second cooling stage 40 is thermally and mechanically connected to an object (not shown) to be cooled so that the coldness is transferred from the second cooling stage 40 to the object.

In the pulse tube refrigerator 1, the refrigerant gas at a high pressure is supplied from the gas compressor 11 via the intake valve 12 and the gas piping 14 to the first stage regenerator tube 31, and the refrigerant gas at a low pressure is discharged from the first stage regenerator tube 31 via the gas piping 14 and the exhaust valve 13 to the gas compressor 11. The hot end 37*a* of the first stage pulse tube 36 is connected via the upper heat exchanger 18*a* and the orifice 17 to the first stage reservoir 15A. Similarly, the hot end 47*a* of the second stage pulse tube 46 is connected via the upper heat exchanger 19*a* and the orifice 17 to the second stage reservoir 15B. Each of the orifices 17 adjusts the phase difference between a pressure change and a volume change of the refrigerant gas that occur periodically in the first stage pulse tube 36 or the second stage pulse tube 46.

Next, operations of the two-stage pulse tube refrigerator 1 are described below. In a first operational mode of the two-stage pulse tube refrigerator 1, the intake valve 12 is opened and the exhaust valve 13 is closed to supply a high-pressure refrigerant gas from the gas compressor 11 to the first stage regenerator tube 31. The refrigerant gas flowing into the first stage regenerator tube 31 is cooled by the cold storage medium 33 and passes through the heat exchanger 60. After passing through the heat exchanger 60, a part of the refrigerant gas flows out of the first flow opening 55 of the cold end 32*b* of the first stage regenerator tube 31, passes through the first flow path 38, and flows into the first stage pulse tube 36. The high-pressure refrigerant gas flowing into the first stage pulse tube 36 compresses a low-pressure refrigerant gas that is originally in the first stage pulse tube 36. As a result, the pressure of the refrigerant gas in the first stage pulse tube 36 becomes greater than the pressure in the first stage reservoir 15A, and the refrigerant gas flows into the first stage reservoir 15A via the orifice 17 and a gas flow path 16.

Meanwhile, another part of the refrigerant gas passing through the heat exchanger 60 flows into the second stage regenerator tube 41 via the second flow path 58 connected to the second flow opening 57 of the cold end 32*b* of the first stage regenerator tube 31. The refrigerant gas is further cooled by the cold storage medium 43, passes through the cold end 42*b* of the second stage regenerator tube 41 and the gas flow path 48, and flows into the second stage pulse tube 46. The high-pressure refrigerant gas flowing into the second stage pulse tube 46 compresses a low-pressure refrigerant gas that is originally in the second stage pulse tube 46. As a result, the pressure of the refrigerant gas in the second stage pulse tube 46 becomes greater than the pressure in the second stage reservoir 15B, and the refrigerant gas flows into the second stage reservoir 15B via the orifice 17 and a gas flow path 16.

Next, in a second operational mode of the two-stage pulse tube refrigerator 1, the intake valve 12 is closed and the exhaust valve 13 is opened. As a result, the refrigerant gas in the first stage pulse tube 36 passes through the first flow path 38 and the first flow opening 55, and then passes through the first stage regenerator tube 31 while cooling the heat exchanger 60 and the cold storage medium 33. Similarly, the refrigerant gas in the second stage pulse tube 46 passes through the second stage regenerator tube 41 while cooling the heat exchanger 49 and the cold storage medium 43. The refrigerant gas passing through the second stage regenerator tube 41 further passes through the second flow path 58 and the second flow opening 57, and passes through the heat exchanger 60 and the cold storage medium 33. Then, the refrigerant gas passes through the hot end 32*a* of the first stage regenerator tube 31 and the exhaust valve 13 and returns to the gas compressor 11.

Since the first stage pulse tube 36 and the second stage pulse tube 46 are connected, respectively, via the orifices 17 to the first stage reservoir 15A and the second stage reservoir 15B, a certain phase difference occurs between the phase of the pressure change and the phase of the volume change of the refrigerant gas. The phase difference causes the refrigerant gas to expand and thereby to generate "coldness" at the cold end 37*b* of the first stage pulse tube 36 and the cold end 47*b* of the second stage pulse tube 46. The two-stage pulse tube refrigerator 1 repeats the above steps to cool an object.

However, the two-stage pulse tube refrigerator 1 has problems as described below.

In the second operational mode, as described above, the refrigerant gas in the second stage regenerator tube 41 passes through the second flow path 58, the second flow opening 57, the heat exchanger 60, and the first stage regenerator tube 31 before returning to the gas compressor 11.

With this configuration, a substantial amount of coldness is transferred from the refrigerant gas to the cold storage medium 43 before the refrigerant gas passes through the hot end 42*a* of the second stage regenerator tube 41. Accordingly, the cooling capability of the refrigerant gas has been reduced to a low level when it reaches the second flow path 58 and the heat exchanger 60. In other words, when the refrigerant gas reaches the heat exchanger 60, the temperature of the refrigerant gas has become similar to the temperature (e.g., about 40 K) of the heat exchanger 60 and therefore the refrigerant gas has little capability to cool the heat exchanger 60.

Meanwhile, regardless of whether heat exchange occurs between the heat exchanger 60 and the refrigerant gas from the second stage regenerator tube 41, the pressure of the refrigerant gas drops as long as the refrigerant gas passes through the heat exchanger 60 in the second operational mode. Thus, every time when the refrigerant gas flows from the second stage regenerator tube 41 via the second flow path 58 and the second flow opening 57 and passes through the heat exchanger 60, the pressure of the refrigerant gas drops "unnecessarily". Such pressure loss may decrease the total cooling capability of the pulse tube refrigerator 1 and therefore has to be reduced.

An aspect of the present invention provides a multi-stage pulse tube refrigerator that makes it possible to significantly reduce "unnecessary" pressure loss of a refrigerant gas passing through a cold end of a first stage regenerator tube.

A two-stage pulse tube refrigerator 100 according to an embodiment of the present invention is described below with reference to FIG. 2.

Figure 2:
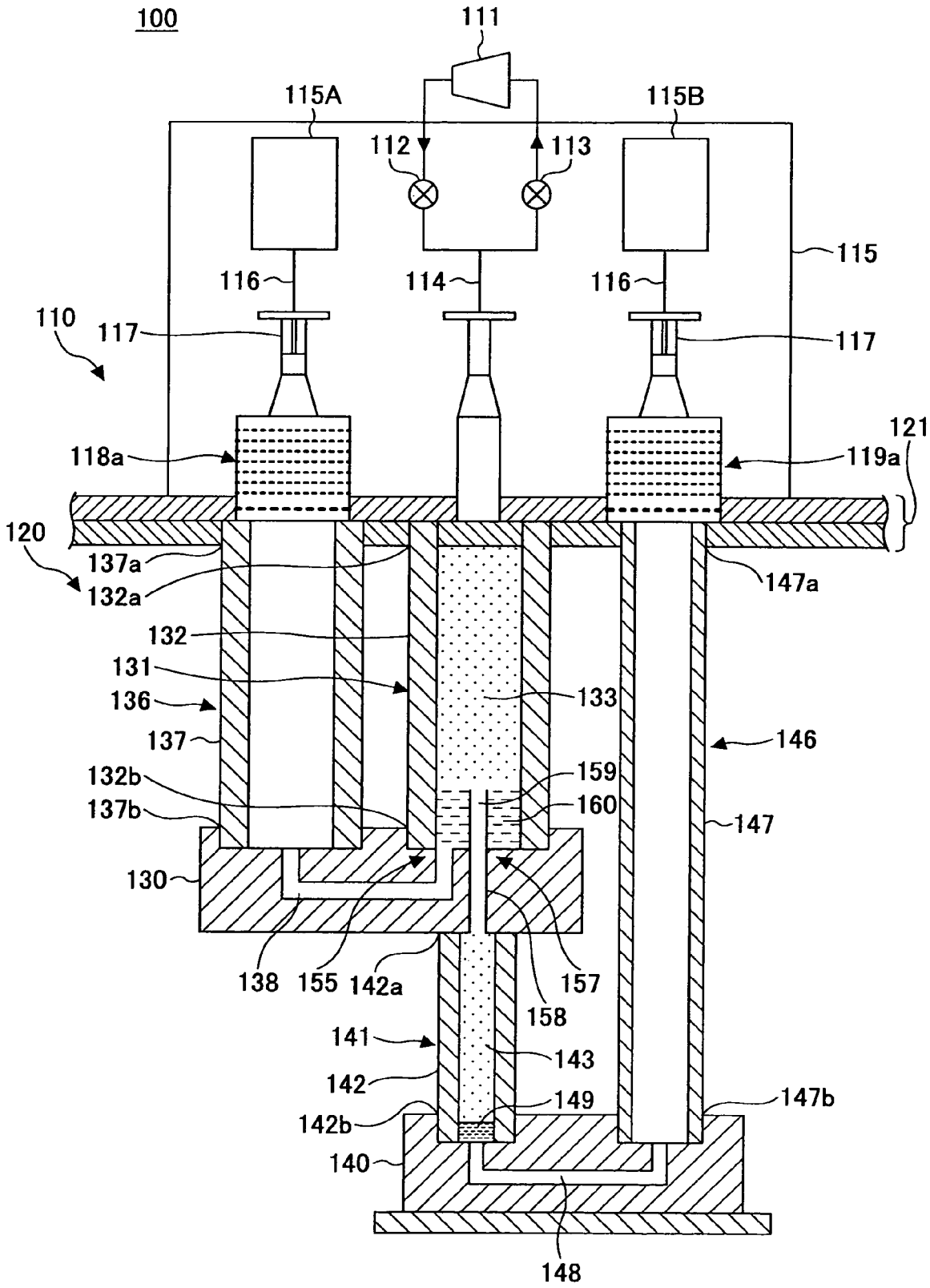
FIG. 2 is a schematic diagram illustrating an exemplary configuration of a two-stage pulse tube refrigerator according to an embodiment of the present invention.

In FIG. 2, reference numbers of components corresponding to those shown in FIG. 1 are obtained by adding 100 to the reference numbers used in FIG. 1.

As shown in FIG. 2, the two-stage pulse tube refrigerator 100 of this embodiment includes a gas compressor 111, a housing unit 110, a flange 121, and a cold head 120 connected via the flange 121 to the housing unit 110. Here, descriptions of components of the two-stage pulse tube refrigerator 100 similar to those of the two-stage pulse tube refrigerator 1 are omitted.

The two-stage pulse tube refrigerator 100 of this embodiment is different from the two-stage pulse tube refrigerator 1 in the configuration of the first stage regenerator tube as described in detail below.

The two-stage pulse tube refrigerator 100 includes a first stage regenerator tube 131 including a heat exchanger 160. A cold end 132*b* of the first stage regenerator tube 131 has a first flow opening 155 and a second flow opening 157. The first flow opening 155 corresponds to the first flow opening 55 of the two-stage pulse tube refrigerator 1 and is connected to a first flow path 138 formed in a first cooling stage 130. Meanwhile, the second flow opening 157 is connected to a through path 159 passing through the heat exchanger 160 and to a second flow path 158 formed in the first cooling stage 130. Accordingly, the through path 159 and the second flow path 158 are connected to each other. Thus, a flow path formed by the through path 159 and the second flow path 158 bypasses the heat exchanger 160. The through path 159 and the second flow path 158 may be collectively called a second flow path.

With this configuration, a refrigerant gas from a second stage regenerator tube 141 passes through the second flow path 158, the second flow opening 157, and the through path 159, and flows into the first stage regenerator tube 131 without passing through the heat exchanger 160. Meanwhile, the refrigerant gas from a first stage pulse tube 136 passes through the first flow path 138, the first flow opening 155, and the heat exchanger 160 as usual, and flows into the first stage regenerator tube 131.

With the configuration of this embodiment, in the second operational mode of the two-stage pulse tube refrigerator 100, the refrigerant gas from the second stage regenerator tube 141 flows into the first stage regenerator tube 131 via the second flow path 158, the second flow opening 157, and the through path 159 by bypassing the heat exchanger 160. Thus, this embodiment makes it possible to significantly reduce "unnecessary" pressure loss of the refrigerant gas.

As described above, in the second operational mode, a substantial amount of coldness is transferred from the refrigerant gas to a cold storage medium 143 before the refrigerant gas flows out of a hot end 142*a* of the second stage regenerator tube 141 into the first stage regenerator tube 131. In other words, the cooling capability of the refrigerant gas has been reduced to a low level when it reaches the second flow path 158 (e.g., the temperature of the refrigerant gas drops to about 40 K). Therefore, the heat transfer efficiency at the heat exchanger 160 is not substantially reduced even if the refrigerant gas is caused to bypass the heat exchanger 160.

In short, this embodiment makes it possible to significantly reduce "unnecessary" pressure loss of the refrigerant gas passing through the cold end 132*b* of the first stage regenerator tube 131 while maintaining the heat transfer efficiency at the cold end 132*b*.

Descriptions of the flow of the refrigerant gas in the first operational mode of the two-stage pulse tube refrigerator 100 are omitted here. However, it is apparent that the configuration of the above embodiment also makes it possible to significantly reduce the pressure loss of the refrigerant gas passing through the heat exchanger 160 in the first operational mode.

In FIG. 2 (and FIG. 1), a perforated plate is taken as an example of the heat exchanger 160 provided at the cold end 132*b* of the first stage regenerator tube 131. However, the heat exchanger 160 may have any other appropriate configuration. For example, the heat exchanger 160 may be implemented by a plate having slits or may be implemented as a gap (or clearance) formed between the inner wall of the first stage regenerator tube 141 and another part (here, such a heat exchanger is called a "clearance-type" heat exchanger).

Figure 3:
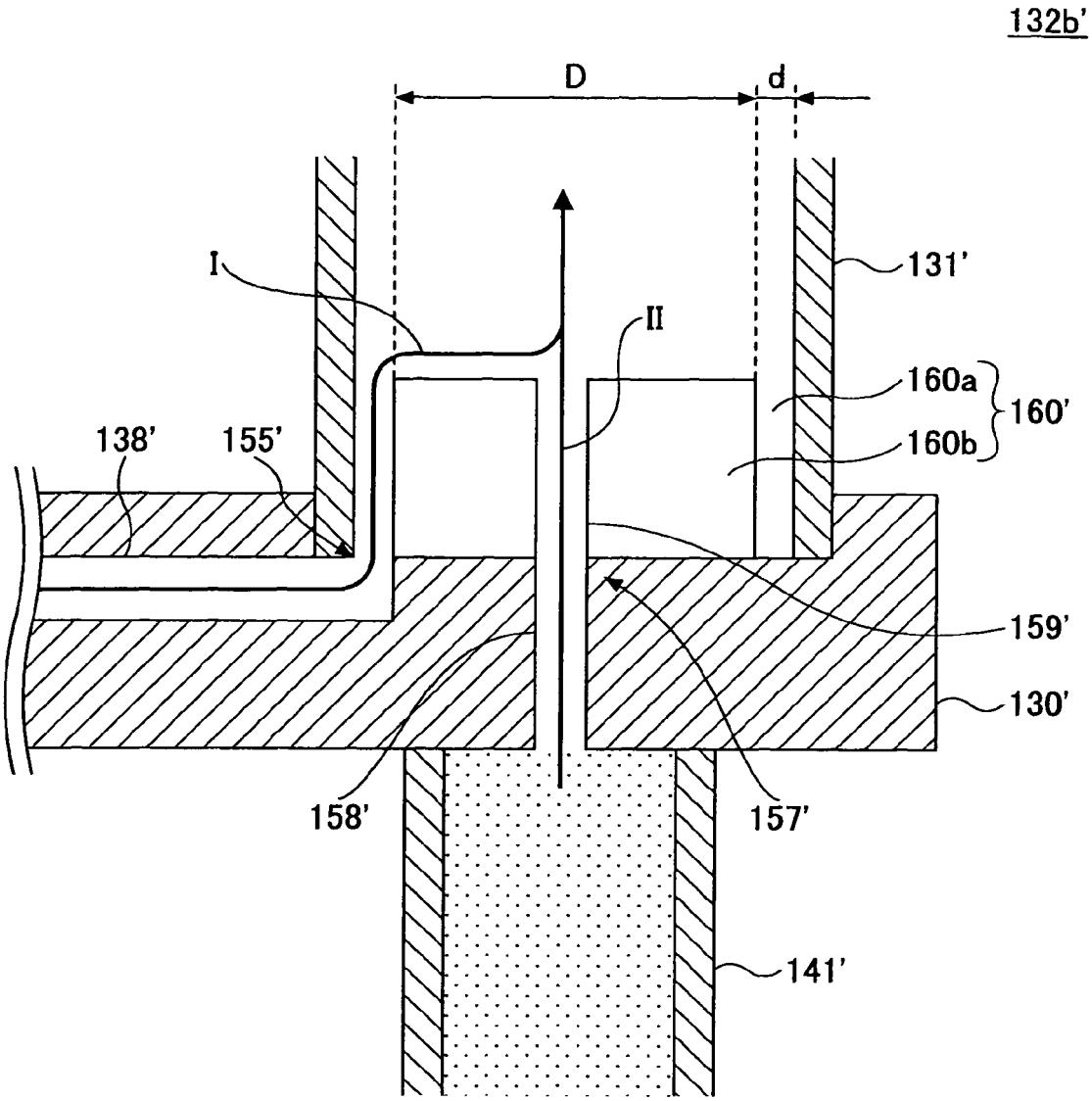
FIG. 3 is an enlarged view illustrating another configuration of a cold end of a first stage regenerator tube of a two-stage pulse tube refrigerator according to an embodiment of the present invention.

FIG. 3 is an enlarged view of a cold end 132*b*' of a first stage regenerator tube 131' that is a variation of the first stage regenerator tube 131. The first stage regenerator tube 131' includes a "clearance-type" heat exchanger 160'.

As shown in FIG. 3, the heat exchanger 160' is provided at the cold end 132*b*' of the first stage regenerator tube 131'. The heat exchanger 160' includes a plug 160*b* placed in the center of the cold end 132*b*' and is implemented as a circumferential gap 160*a* formed between the outer surface of the plug 160*b* and the inner wall of the first stage regenerator tube 131'. The gap 160*a* is connected via a first flow opening 155' to a first flow path 138'. A through path 159' is formed in the plug 160*b* of the heat exchanger 160'. The through path 159' is connected via a second flow opening 157' to a second flow path 158'.

With this configuration, in the second operational mode, a refrigerant gas from a second stage regenerator tube 141' flows through the second flow path 158' and the through path 159' into the first stage regenerator tube 131' without passing through the heat exchanger 160' as indicated by arrow II in FIG. 3. Here, the second flow path 158' and the through path 159' may be collectively called a second flow path. This configuration also prevents the refrigerant gas in the second stage regenerator tube 141' from passing through the heat exchanger 160' and thereby makes it possible to significantly reduce "unnecessary" pressure loss of the refrigerant gas.

In the above embodiment, a two-stage pulse tube refrigerator is used as an example. However, the present invention may also be applied to a multi-stage pulse tube refrigerator having three or more stages.

Also in the above embodiment, heat exchangers (160 and 149) are provided only in the first stage regenerator tube 131 and the second stage regenerator tube 141. However, a part of the heat exchanger 160 of the first stage regenerator tube 131 and/or a part of the heat exchanger 149 of the second stage regenerator tube 141 may be provided in the first stage pulse tube 136 and/or the second stage pulse tube 146. This configuration makes it possible to reduce the sizes (or heights) of the heat exchanger 160 of the first stage regenerator tube 131 and/or the heat exchanger 149 of the second stage regenerator tube 141, and thereby makes it possible to reduce the total size of the pulse tube refrigerator 100.

Examples

To quantitatively evaluate effects of the above embodiment, differences in pressure (i.e., pressure losses ΔP) of the refrigerant gas before and after passing through the heat exchanger of the first stage regenerator tube were simulated for the pulse tube refrigerator 1 and the pulse tube refrigerator 100. Also, differences ΔT between the temperature of the heat exchanger of the first stage regenerator tube and the temperature of the refrigerant gas at the heat exchanger were simulated. In Example 1, simulations were performed for the pulse tube refrigerator 1 based on an assumption that the heat exchanger 60 was a "clearance-type" heat exchanger. In Example 2, simulations were performed for the pulse tube refrigerator 100 based on an assumption that the heat exchanger 160 was a "clearance-type" heat exchanger (i.e., the heat exchanger 160'). Also, parameters shown in table 1 below were used as preconditions for the simulations.

TABLE 1

| Preconditions (parameters) | Example 1 | Example 2 |
|---|---|---|
| High pressure $P_1$ (MPa) of refrigerant gas | 2 | 2 |
| Low pressure $P_2$ (MPa) of refrigerant gas | 1.1 | 1.1 |
| Temperature (K) of first cooling stage (30, 130) | 40 | 40 |
| Gas temperature $T_1$ (K) at first flow opening (55, 155) | 35 | 35 |

TABLE 1-continued

| Preconditions (parameters) | Example 1 | Example 2 |
|---|---|---|
| Gas temperature $T_2$ (K) at second flow opening (57, 157) | 40 | 40 |
| Flow rate $v_1$ (g/s) of refrigerant gas flowing through first stage pulse tube (36, 136) | 3.5 | 3.5 |
| Flow rate $v_2$ (g/s) of refrigerant gas flowing through second stage regenerator tube (41, 141) | 3.5 | 3.5 |
| Flow rate $v_3$ (=$v_1$ + $v_2$) (g/s) of refrigerant gas passing through heat exchanger (60, 160') of first stage regenerator tube (31, 131) | 7 | 3.5 |
| Length (height) L (mm) of heat exchanger (60, 160') | 40 | 40 |
| Outside diameter D (distance D in FIG. 3) (mm) of plug (N/A, 160b) of heat exchanger (60, 160') | 40 | 40 |
| Width d (width d in FIG. 3) (mm) of gap (N/A, 160a) of heat exchanger (60, 160') | 0.2 | 0.2 |
| Hydraulic diameter Dh (mm) (Dh = 2d) | 0.4 | 0.4 |
| Refrigeration capacity Qc (W) of first cooling stage (30, 130) | 40 | 40 |
| Heat exchange area Ah ($mm^2$) of heat exchanger (60, 160') | 10098.2 | 10098.2 |

In table 1, to clarify the parameters, reference numbers are attached to the corresponding components. As described above, simulations in Example 1 were performed based on an assumption that the heat exchanger 60 was a "clearance-type" heat exchanger. For this reason, reference numbers of components of the heat exchanger 60 that are not shown in FIG. 1 are indicated by "N/A".

First, based on the parameters shown in table 1, a pressure loss ΔPh (kPa) of the refrigerant gas that occurs in the first operational mode when a high-pressure refrigerant gas flows through the heat exchanger (60, 160') of the first stage regenerator tube toward the first stage pulse tube (and the second stage regenerator tube in the case of Example 1) was calculated using the following formula (1):

$$\Delta Ph=0.5\times f\times L/Dh\times\rho\times v^2 \quad (1)$$

In formula (1), "f" indicates a friction coefficient. When Re is a Reynolds number, "f" is represented by the following formula (2):

$$f=4\times0.0791\times Re^{0.25} \quad (2)$$

Also in formula (1), L (mm) indicates a height of the heat exchanger (60, 160'); Dh indicates a hydraulic diameter (mm) and is twice the width d of the gap 160*a*; ρ (g/$mm^3$) indicates a density (g/$mm^3$) of the refrigerant gas at the heat exchanger (60, 160') and is obtained based on $P_1$, $P_2$, $T_1$, and $T_2$ shown in table 1; and v (mm/s) indicates a flow rate of the refrigerant gas at the heat exchanger (60, 160') and is obtained based on $v_1$ and $v_2$ shown in table 1. Reynolds number Re is obtained by the following formula (3):

$$Re=\rho\times v\times Dh/\mu \quad (3)$$

In formula (3), μ indicates a viscosity of the refrigerant gas at the heat exchanger (60, 160').

The calculation results were ΔPh=35.6 kPa in Example 1 and ΔPh=10.6 kPa in Example 2.

Next, a pressure loss ΔP1 (kPa) of the refrigerant gas that occurs in the second operational mode when a low-pressure refrigerant gas from the first stage pulse tube (and the second stage regenerator tube in the case of Example 1) passes through the heat exchanger (60, 160') of the first stage regenerator tube was calculated using the following formula (4):

$$\Delta P1=0.5\times f\times L/Dh\times\rho\times v^2 \quad (4)$$

The calculation results were ΔP1=36.1 kPa in Example 1 and ΔP1=10.7 kPa in Example 2.

Based on the above results, a total pressure loss ΔP of the refrigerant gas in one cycle was calculated using the following formula (5):

$$\Delta P=\Delta Ph+\Delta P1 \quad (5)$$

Meanwhile, based on the parameters shown in table 1, a temperature difference ΔT between the temperature of the heat exchanger (60, 160') and the temperature of the refrigerant gas at the heat exchanger was calculated using the following formula (6):

$$\Delta T=Qc/K1 \quad (6)$$

In formula (6), Qc (W) (here, Qc=40 W) indicates a refrigeration capacity of the first cooling stage (30, 130) and K1 (W/K) indicates a heat transfer coefficient represented by the following formula (7):

$$K1=\alpha\times Ah \quad (7)$$

In formula (7), Ah (mm) indicates a heat exchange area obtained from the surface area of the heat exchanger (60, 160'), and a is represented by the following formula (8):

$$\alpha=0.023\times Re^{0.8}\times Pr^{0.35}\times\lambda/Dh \quad (8)$$

In formula (8), Pr indicates a Prandtl number (Pr=0.72) and λ (W/m*K) indicates a thermal conductivity of the heat exchanger (60, 160'). Here, λ=0.044 W/m*K.

Results (ΔP and ΔT) of the above calculations in Example 1 and Example 2 are shown in table 2.

TABLE 2

| Calculation results | Example 1 | Example 2 |
|---|---|---|
| Pressure loss ΔPh (kPa) of high-pressure refrigerant gas flowing through heat exchanger (60, 160') | 35.6 | 10.6 |
| Pressure loss ΔPl (kPa) of low-pressure refrigerant gas flowing through heat exchanger (60, 160') | 36.1 | 10.7 |
| Total pressure loss ΔP (kPa) in one cycle (ΔP = ΔPh + ΔPl) | 71.7 | 21.3 |
| Temperature difference ΔT (K) between refrigerant gas and heat exchanger (60, 160') (gap 160a in FIG. 3) | 0.3 | 0.5 |

As shown in table 2, the total pressure loss ΔP in Example 1 was about 71.7 kPa and the total pressure loss ΔP in Example 2 was about 21.3 kPa. Thus, compared with Example 1, the pressure loss of the refrigerant gas was significantly reduced. Meanwhile, the temperature difference ΔT between the heat exchanger and the refrigerant gas at the heat exchanger was about 0.3 K in Example 1 and about 0.5 K in Example 2. Thus, the temperature differences ΔT in Example 1 and Example 2 were almost equal.

As evidenced by the results, configuring a flow path for a refrigerant gas such that the refrigerant gas bypasses the heat exchanger of the first stage regenerator tube when it flows from the second stage regenerator tube into the first stage regenerator tube (or vice versa) makes it possible to significantly reduce the pressure loss of the refrigerant gas without reducing the heat transfer efficiency at the heat exchanger.

The present invention is not limited to the specifically disclosed embodiments, and variations and modifications may be made without departing from the scope of the present invention.

The present application is based on Japanese Priority Application No. 2009-094309, filed on Apr. 8, 2009, the entire contents of which are hereby incorporated herein by reference.

What is claimed is:

1. A multi-stage pulse tube refrigerator, comprising:

a first stage regenerator tube including a heat exchanger;

a second stage regenerator tube;

a first stage pulse tube;

a second stage pulse tube;

a first cooling stage connected to a cold end of the first stage regenerator tube and a cold end of the first stage pulse tube; and a second cooling stage connected to a cold end of the second stage regenerator tube and a cold end of the second stage pulse tube, wherein the cold end of the first stage regenerator tube is in communication with the first stage pulse tube via a first flow path and in communication with a hot end of the second stage regenerator tube via a second flow path;

the first flow path is configured such that a heat exchange occurs between the heat exchanger and a refrigerant gas flowing through the first flow path; and the second flow path is configured such that the refrigerant gas flowing through the second flow path is fluidically isolated from the heat exchanger, wherein the refrigerant gas flows to and from the second stage regenerator tube without contacting the heat exchanger.

2. The multi-stage pulse tube refrigerator as claimed in claim 1, wherein the heat exchanger is implemented as a gap formed between an inner wall of the first stage regenerator tube and a plug in the first stage regenerator tube.

3. The multi-stage pulse tube refrigerator as claimed in claim 1, wherein the second flow path is a through path formed through the heat exchanger.

4. The multi-stage pulse tube refrigerator as claimed in claim 1, wherein a heat exchanger is also provided at the cold end of the second stage pulse tube.

5. The multi-stage pulse tube refrigerator as claimed in claim 1, wherein the multi-stage pulse tube refrigerator is a two-stage pulse tube refrigerator.

6. The multi-stage pulse tube refrigerator as claimed in claim 1, further comprising a hollow structure extending through the heat exchanger, the hollow structure defining, at least in part, the second flow path.

7. The multi-stage pulse tube refrigerator as claimed in claim 6, wherein the hollow structure is a tube.

* * * * *